US006799136B2

(12) United States Patent
Patel et al.

(10) Patent No.: US 6,799,136 B2
(45) Date of Patent: Sep. 28, 2004

(54) METHOD OF ESTIMATION OF WAFER POLISH RATES

(75) Inventors: Nital Patel, Plano, TX (US); Gregory A. Miller, Richardson, TX (US); Steven T. Jenkins, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 152 days.

(21) Appl. No.: 10/214,694

(22) Filed: Aug. 8, 2002

(65) Prior Publication Data

US 2003/0054644 A1 Mar. 20, 2003

Related U.S. Application Data

(60) Provisional application No. 60/310,853, filed on Aug. 9, 2001, and provisional application No. 60/313,460, filed on Aug. 21, 2001.

(51) Int. Cl.[7] ..... G06F 19/00; G01R 31/26

(52) U.S. Cl. ..... 702/127; 700/121; 438/14

(58) Field of Search ..... 702/127, 170, 702/172; 700/121, 123; 438/14, 5, 7, 692

(56) References Cited

U.S. PATENT DOCUMENTS 5,964,643 A * 10/1999 Birang et al. ..... 451/6
6,476,921 B1 * 11/2002 Saka et al. ..... 356/630
6,517,412 B2 * 2/2003 Lee et al. ..... 451/5
6,524,165 B1 * 2/2003 Wiswesser et al. ..... 451/6
6,524,959 B1 * 2/2003 Lu et al. ..... 438/690
RE38,029 E * 3/2003 Cote et al. ..... 438/16
6,589,800 B2 * 7/2003 Patel et al. ..... 438/14
2002/0058460 A1 * 5/2002 Lee et al. ..... 451/5
2003/0045100 A1 * 3/2003 Saka et al. ..... 438/689

OTHER PUBLICATIONS

Ouma et al., "Characterization and Modeling of Oxide Chemical–Mechanical Polishing Using Planarization Lenght and pattern Density Concepts", IEEE, 2002.*
Patel et al., "In Situ Estimation of Blanket Polish Rates and Wafer–to–Wafer Variation", IEEE, 2002.*
Fang et al., "Control of Dielectric Chemical Mechanical Polishing (CMP) Using an Interferometry Based Endpoint Sensor",IEEE, 1998.*
Boning et al., "Run by Run Control of Chemical–Mechnaical Polishing", IEEE, 1995.*

* cited by examiner

*Primary Examiner*—Patrick Assouad
(74) *Attorney, Agent, or Firm*—W. James Brady, III; Frederick J. Telecky, Jr.

(57) ABSTRACT

A method for extracting blanket (qual) polish rates from interferometry signals off patterned (product) wafer polish during non-enpointed CMP. The method includes estimating polish rates using polish data near the end of the polish period. Non-linear regression and iterative optimization is presented to extract relevant information. The processing includes least square processing step (43), determining the search fit (44) and determining if this is the best fit (45).

10 Claims, 7 Drawing Sheets

METHOD OF ESTIMATION OF WAFER POLISH RATES

This application claims priority under 35 U.S.C. §119(e) (1) of provisional application numbers 60/310,853, filed Aug. 9, 2001 and 60/313,460 filed Aug. 21, 2001.

FIELD OF INVENTION

This invention relates to wafer polishing and more particularly to estimating wafer polish rates.

BACKGROUND OF THE INVENTION

In semiconductor fabrication wafers, such as silicon wafers, after undergoing the pattern processes of forming products such as electronic devices, etc. thereon are coated by a layer of glass or oxide that is on the active layer. Chemical-mechanical polishing (CMP) is widely used as a process for achieving global planarization in semiconductor manufacturing. See G. Shinn, V. Korthuis, A., Wilson, G. Grover, and S. Fang, "Chemical-mechanical polish," in *Handbook of Semiconductor Manufacturing Technology*, ch. 15, pp.415–460, NY: Marcel Dekker, Y, Nishi and R. Doering ed., 2000. The result of the pattern on the wafers makes the polishing rate non-linear. The hills and valleys resulting from the products under the glass oxide make for the non-linear polishing.

CMP processes can be categorized into two classes for control purposes: (i) endpointed, and (ii) non-endpointed. In case of endpointed processes, the polish usually involves removal of the film being polished until one hits a stopping layer. Examples of this type of polish include tungsten, STI and copper (damascene) CMP. The endpoint in these cases depends on the difference in the physical properties of the film being polished vs. the stopping layer. Properties commonly used are reflectivity and friction. In contrast to these, non-endpointed processes involve targeting the polish to leave behind a film of a specific thickness. Examples include PMD, LLD and FSG CMP. Typically these processes have proven harder to endpoint in volume production. It is the control of these processes that is the focus of this application. Henceforth, CMP will be used to explicitly refer to such non-endpointed processes.

A key parameter in the control of non-endpointed processes is the blanket polish rate. These blanket (qual) rates are determined using wafers that are not patterned placed on the pad and polished. They are called pilots. The rate of removal of these pilot wafers is linear. This rate of the pilot wafers is the reference rate to which pattern dependent product polish rates are compared. The role of this was highlighted in N. S. Patel, G. A. Miller, C. Guinn, A,. Sanchez, and S., T. Jenkins, "Device dependent control of chemical-mechanical polishing of dielectric films," *IEEE Transactions on Semiconductor Manufacturing*, vol. 13, no. 3, pp. 331–343, 2000. This article of Patel et al. reports a state of the art control scheme for controlling these processes based on metrology feedback. Metrology is the measurement of the wafer before and after the polishing. It measures what is left. This is measured with a metrology tool to determine if there is a problem on a lot of wafers. The scheme in Patel et al, cited above, attempts to minimize performance sensitivity to qual wafer frequency, and hence blanket rate samples. However, blanket rate sampling is a prerequisite for any CMP control scheme, since without these samples one loses all observability to the parameters being estimated for control. Applied Materials (AMAT) has proposed interferometry for endpointing, and estimation of blanket rates for such processes on their Mirra polishers. See Birong et al. U.S. Pat. No. 5,964,643. This patent is incorporated herein by reference. However, their algorithms have proven ineffective in both these areas. It is now recognized that reliably endpointing such processes in the presence of production disturbances and shortening polish times is infeasible. Issues lie with varying incoming material thickness off multiple deposition chambers that trigger false endpoints and the quality of the sensor signal (which is viewing the wafer through the slurry) that often results in missed endpoints. On the other hand, estimation of blanket rates is a feasible proposition, however; AMATs algorithm works only on blanket wafers, and is unable to predict blanket rates off product polish which is the case of interest.

SUMMARY OF THE INVENTION

In accordance with one embodiment of the present invention a method and system for providing an improved estimate of the blanket (qual) rate from less than a full interferometry trace cycle of product polish data after the planarization region.

DESCRIPTION OF PREFERRED EMBODIMENTS

Figure 1:
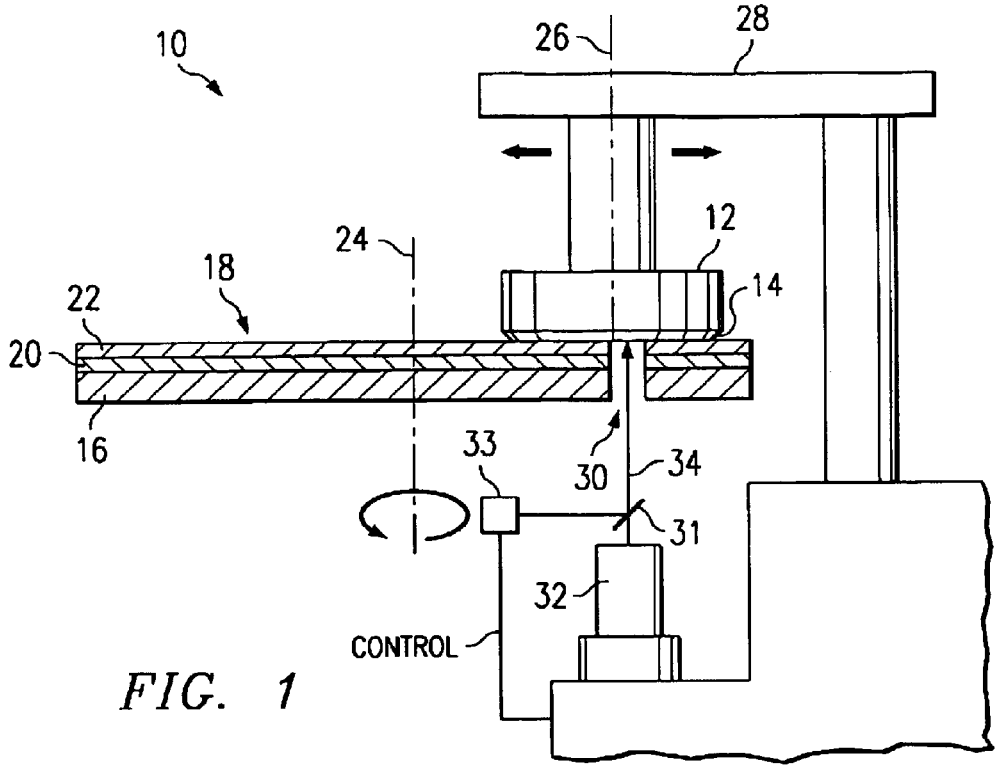
FIG. 1 illustrates a diagram of a polisher including polish head, wafer, pad and the laser signal.

In accordance with a preferred embodiment of the present invention an AMAT Mirra CMP polisher 10 is used as illustrated in FIG. 1. The set up may comprise a polish head 12 for holding a semiconductor wafer 14 being polished against a polishing platen 16 covered with a pad 18. The pad 18 has a backing layer 20 and covering layer 22 which is used with a chemical polishing slurry to polish the wafer. The pad material 22 is for example an open cell foamed polyurethane or a sheet of polyurethane with a grooved surface. The pad material is wetted with the chemical polishing slurry. The platen 16 is rotated about a central axis 24. The polishing head 12 is rotated about it's axis 26 and translated across the surface of the platen 16 by a translation arm 28. The polisher includes a laser 32 aimed at a light passing window 30 in the platen 16, pad 18 and covering 22 to the wafer 14. The laser 32 generates a signal which is passed through the window 30 and reflected off the wafer back through the window 30 and coupled through a splitter 31 to light detector 33. In practice there may be four such polish heads and three such platens. While one head is unloading and loading a wafer, the other three heads are positioned over each of the three platens. A wafer is polished partially on the first platen, then on the second platen, and buffed or polished on the third platen. The head is moved from platen to platen as the wafer is processed. For the preferred embodiment, signals from all polish platens are concatenated together. In the prior art, the reflected laser signal is sampled during the available acquisition in each revolution. The first and second reflected beams which form the resultant beam when they are in phase cause a maxima at the detector end and when out of phase cause minima. The result is that the output signal varies cyclically with the thickness of the oxide layer as it is reduced. The signal varies in a sinusoidal manner. The period of the interference signal is controlled by the rate at which the material is removed from the oxide layer. The rate at which the material is removed is a factor of the of the downward pressure on the wafer against the platen, the relative velocity between the platen and the wafer, and the wafer topography. During each period of the signal a certain thickness of the oxide is removed. The thickness removed is proportional to the wavelength of the laser beam and the index of refraction of the oxide layer. The amount of thickness removed per period is approximately $\lambda/2n$ where $\lambda$ is the free space wavelength and n is the index of refraction of the oxide layer. The number of cycles is counted and the thickness of the material removed by one cycle is computed from the wavelength of the laser beam and the index of refraction. Alternatively this measurement is determined by peak to peak or peak to valley. The present invention relates to an improved method of processing of the received signals in a processing system to generate control signal to control the polisher 10. The system estimates the wafer polish rates and the wafer-to-wafer thickness variation. This is then used to control the polisher 10.

Figure 2:
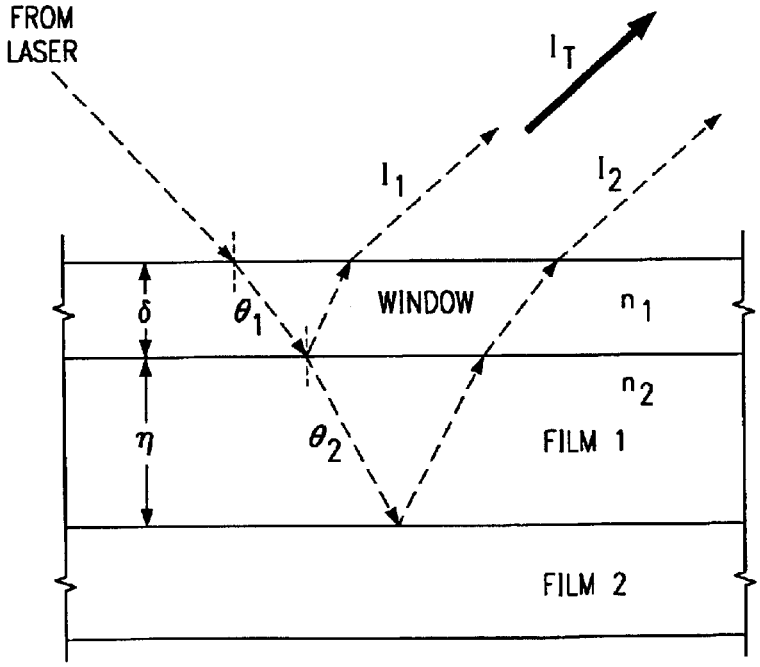
FIG. 2 illustrates interferometry.

The setup of the laser signal on the AMAT Mirra CMP polishers is as shown in FIG. 1. Note that the signal must go through the window 30 on the pad 18, and the slurry. This makes the signal susceptible to degradation due to clouding out of the window, window thickness variation as well as particles in the slurry. The signal going to the detector is comprised of beams reflected off multiple film interfaces. For simplicity, assume that there are only two beams, as shown in FIG. 2 where $I_1$ is the reflection off the window and film 1 and $I_2$ is the reflection from the silicon oxide (film 1) and the underlying film (film 2) interface. The underlying film (film 2) is different in optical characteristics than the oxide film (film 1) and could be amongst other things: aluminum, silicon nitride, or copper. The illustration assumes that any reflection from the window is much smaller than the reflection from the window and film 1 and the film 1-film 2 interface. Furthermore, reflections from additional layers in the wafer are ignored. The oxide and polishing may be after placing the circuit layers or between circuit layers. The intensity ($I_T$) of the signal detected can be expressed (See M. Born and E. Wolf, *Principles of Optics: Electromagnetic Theory of Propagation Interference and Diffraction of Light*. Elmsford, N.Y.: Pergamon Press, 6th ed., 1980) as follows:

$$I_T = I_1 + I_2 + 2\sqrt{I_1 I_2}\cos(\xi) \tag{1}$$

where $\xi$ is given by $$\xi = \frac{4\pi}{\lambda o}\cdot(n_2\eta\cos(\theta_2)) = K(\eta)\cdot n \tag{2}$$

where all parameters are as shown in FIG. 2 except $\lambda_0$ which is the wavelength of the incident beam. Hence, $I_T$ is a sinusoid whose instantaneous angular frequency $\omega$ is given by:

$$\omega = \frac{d}{dt}\xi = K(\eta)\frac{d}{dt}\eta + \frac{d}{d\eta}K(\eta)\cdot\frac{d}{dt}\eta = \Gamma(\eta)\rho \tag{3}$$

where $\rho$ is the instantaneous wafer removal rate. Note the stress on instantaneous for the angular frequency. The reason for this is that the removal rate will vary during patterned wafer polish (a key fact ignored by the AMAT algorithm, leading to its failure), as is explained in the next paragraph.

Figure 3A:
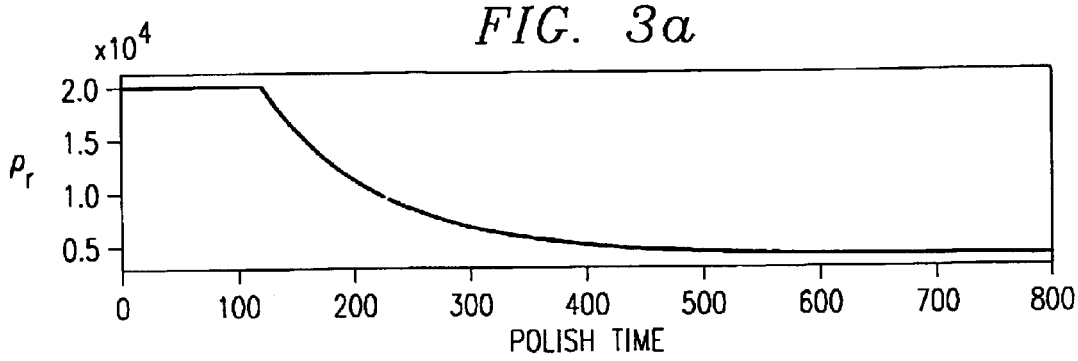
FIG. 3*a* illustrates polish rates for raised areas (top), 3*b* for down areas (middle) and 3*c* for the average wafer polish rate (bottom).
Figure 3B:
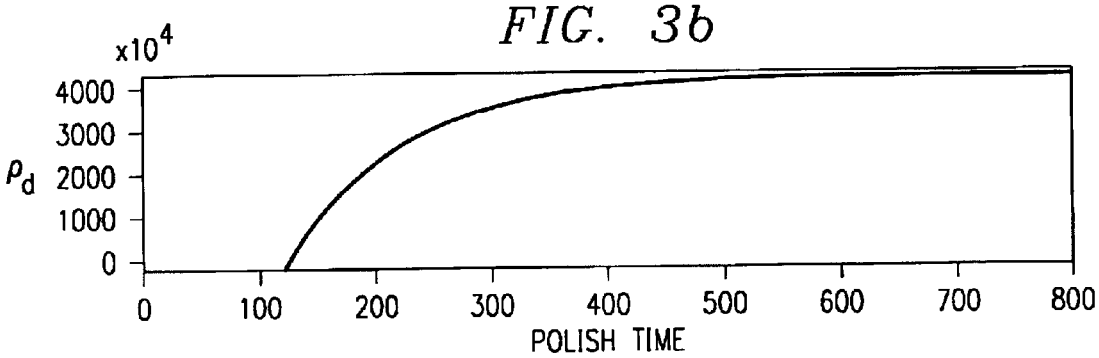
Figure 3C:
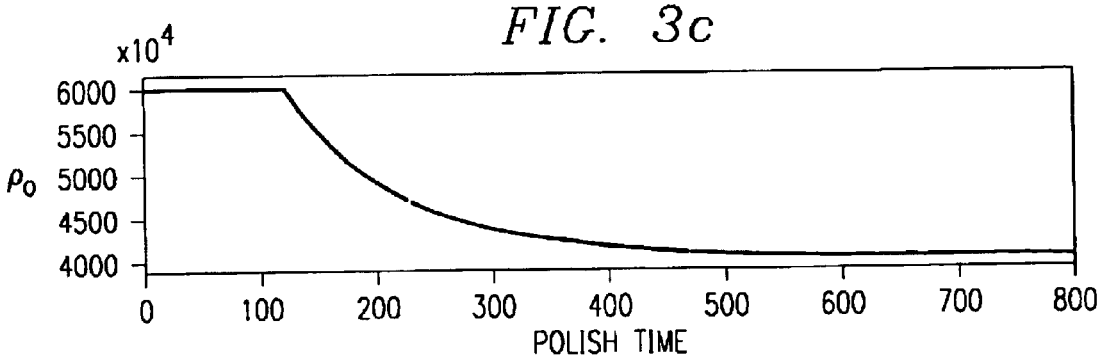

It is well known that the instantaneous polish rate ($\rho$) varies during the polishing of patterned wafers. The IMEC model studies the removal rates of raised ($\rho_r$) and down ($\rho_d$) areas on the wafer. See J. Grillaert, M. Meuris, N. Heyley, K. Devriendt and M. Heyns, "Modeling step height reduction and local removal rates based on pad substrate interactions," in Proceedings CMP-MIC, pp. 79–86, 1998. These rates are modeled as follows:

$$\rho_r(t) = \begin{cases} \rho_o/\kappa, & \text{if } t < t_c \\ \rho_o + (1-\kappa)\frac{m}{\tau}e^{-(t-t_c)/\tau}, & \text{if } t \geq t_c \end{cases}$$

$$\rho_d(t) = \begin{cases} 0, & \text{if } t < t_c \\ \rho_o - \kappa\frac{m}{\tau}e^{-(t-t_c)/\tau}, & \text{if } t \geq t_c \end{cases}$$

where $t_c$, $\tau$, m, and $\kappa$ are dependent on the polishing characteristics of the patterned (product) wafer. FIG. 3 illustrates an example of these rates as generated by the IMEC model, along with the average polish rate ($\rho$) obtained by assuming 30% raised area. FIG. 3*a* illustrates the polished rates for the raised areas with more removal at the start of the polishing. FIG. 3*b* illustrates that the removal rate is less at the start of the polishing period for the down areas. FIG. 3*c* illustrates the average polish rate for the wafer. It is important to note that ultimately all three rates converge to the blanket polish rate ($\rho_o$). This has also been proved out by experimental results in manufacturing. In fact the last 1500 Angstrom of polish is typically in the blanket regime. This can also be inferred from the fact that if the polish stops prior to reaching the blanket regime (where the polish rate of product wafer is linear and follows the blanket rate of pilot wafers), then the wafer surface is yet to be planarized.

Figure 4A:
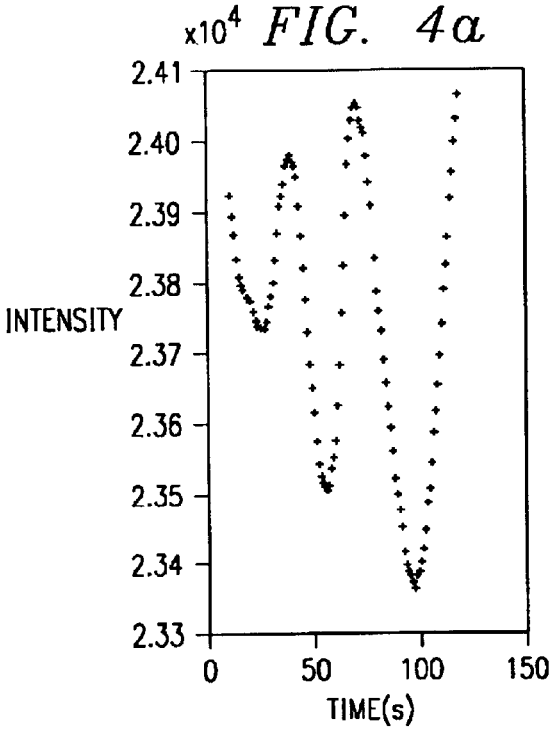
FIGS. 4*a* and 4*b* illustrate good interferometry traces and + denotes sampled data.
Figure 4B:
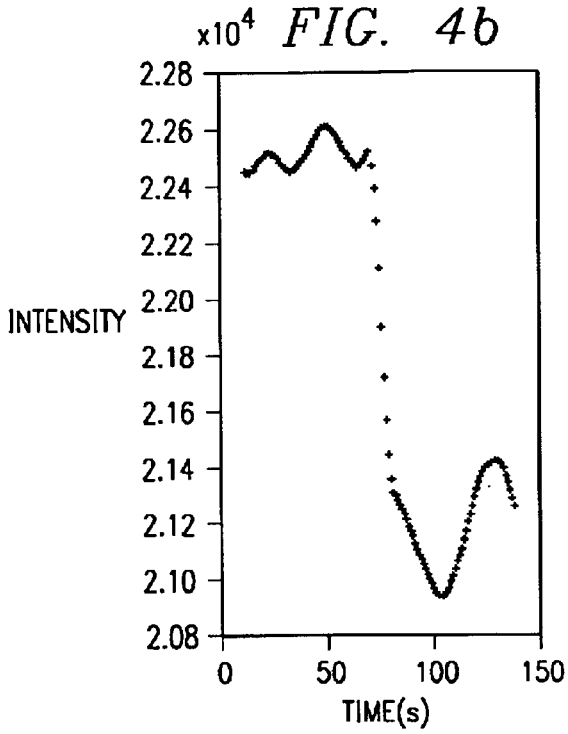

Before proceeding further, it is informative to look at some possible traces. Occasionally, the sensor signal gets corrupted, due to reflections off multiple interface layers, as well as clouding of the pad window. FIGS. 4*a* and 4*b* show examples of some good signals. The reason these apparently different signals are classified as good, is that the dc offsets, and amplitude of the signal are irrelevant for extracting polish rate information. This information is contained in the angular frequency and the phase. Recognizing this fact up front prevents one from employing peak-valley detection algorithms using pre-defined boxes, since these are not robust enough for the case at hand.

As mentioned previously, information regarding blanket polish rates is contained in the angular frequency of the trace, just before polish stops (assuming that the lot has been polished close to target). This portion of the polish is in the blanket regime, and the following assumptions can be made in order to simplify equation (3). In the blanket regime:

Assumption 1. The angular frequency is constant, i.e. $\omega=\omega_0$.

Assumption 2. Optical properties of the film being polished are invariant (i.e. $K(\eta)=K_0$) in the region undergoing blanket polish.

Assumption 3. The window is optically transparent to the laser beam.

Assumption 4. The rate on each of the platens are linearly related.

Figure 5:
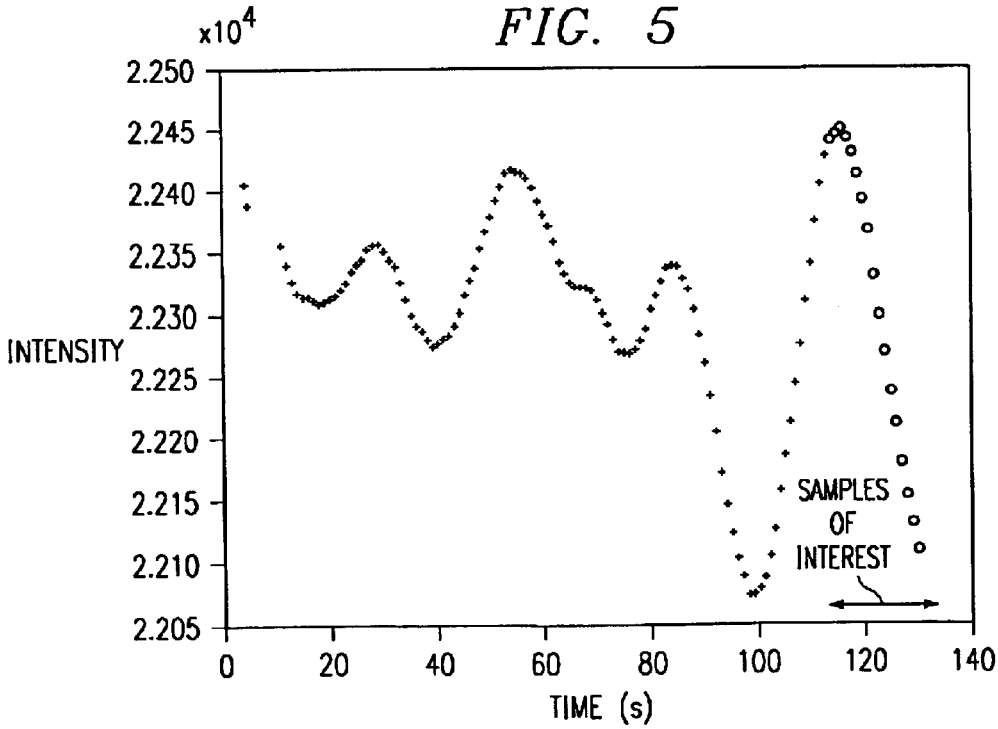
FIG. 5 illustrates an example of a trace showing samples of interest (o) for calculating metrics of interest.

This implies that $$\rho_0=\alpha\omega_0+\beta \tag{4}$$

where $\rho_0$ is the blanket polish rate, $\omega_0$ is the angular frequency of the trace during blanket polish, and $\alpha,\beta$ are constants. Hence, the blanket polish rate ($\rho_0$) is a linear function of the angular frequency ($\omega_0$) during blanket polish. FIG. 5 shows an example of another trace, and marks out the portion of the signal of interest in calculating $\omega_0$ via those marked with "o"s. Note that in this example out of about 130 samples, only 17 samples are of interest.

The limited sample size poses a problem, since it is smaller than that required to apply standard peak-to-peak, or peak-to-valley algorithms. A larger sample size will induce errors in the rate estimate as a portion of the data is from outside the blanket regime. Furthermore, due to the low sampling rates, accurate detection of the peak or valley is also problematic, especially if the peak or valley lies in between two sampling instances. Nonlinear regression (outlined in the following paragraphs) provides a much cleaner procedure for extracting the information of interest. It has the advantages of: (i) being robust to signal amplitude variation, (ii) ability to work with limited available samples, (iii) being able to interpolate between samples, as well as, (iv) giving an indication of the quality of the trace.

Let $$\{y_k\}_{k=0}^{K-1}$$

be the K samples that are of interest to estimate the blanket polish rate. Without loss of generality, it is assumed that these are produced by a constant sampling frequency of $1/\Delta$Hz. It is straightforward to extend the results presented to the case where one has varying sample rates.

Since each head could potentially polish up to a different time, one needs to invert the sampled trace in order to correctly estimate wafer-to-wafer variation. This will become apparent in a later paragraph which present how one estimates wafer-to-wafer variation. Given that polish stops at time $t_K$, one can hypothesize that these samples are generated from a function of the form $$y(t_K-t)=\bar{A}_0+\bar{A}_1\sin(\bar{\omega}_0 t+\bar{\phi})+v(t) \tag{5}$$

where t is the time, and v(t) is zero mean white noise. It is of interest to estimate these parameters. In order to estimate the parameters in equation (5), one could use non-linear least squares, i.e. given $$\{y_k\}_{k=0}^{K-1},\ \lambda_k,\ >0,\ k=0,1,\ldots,K-1,\ \text{find}\ \{A_0^*, A_1^*, \varpi^*, \phi^*\},$$

such that $$\{A_0^*, A_1^*, \varpi^*, \phi^*\} \in \arg\min_{A_0, A_1, \varpi, \phi}\left\{\sum_{k=0}^{k-1}\lambda_k(y_{k-1-k}-A_0-A_1\sin(\varpi\Delta k+\phi))^2\right\}. \tag{6}$$

One can estimate the quality of fit by computing a fit metric (GOF) as follows:

$$GOF = 1-\frac{\sum_{k=0}^{K-1}\lambda_k(y_{K-1-k}-A_0^*-A_1^*\sin(\varpi^*\Delta k+\phi^*))^2}{\sum_{k=0}^{K-1}(y_k-\mu_y)^2} \tag{7}$$

where $$\mu_y=\frac{1}{K}\sum_{k=0}^{k-1}y_k$$

is the empirical mean of $\{y_k\}$, and $A^*_0$, $A^*_1$, $\bar{\omega}^*$, and $\phi^*$ are the parameter estimates. A better the fit, the closer the value of Goodness Of Fit (GOF) is to 1.

Figure 6:
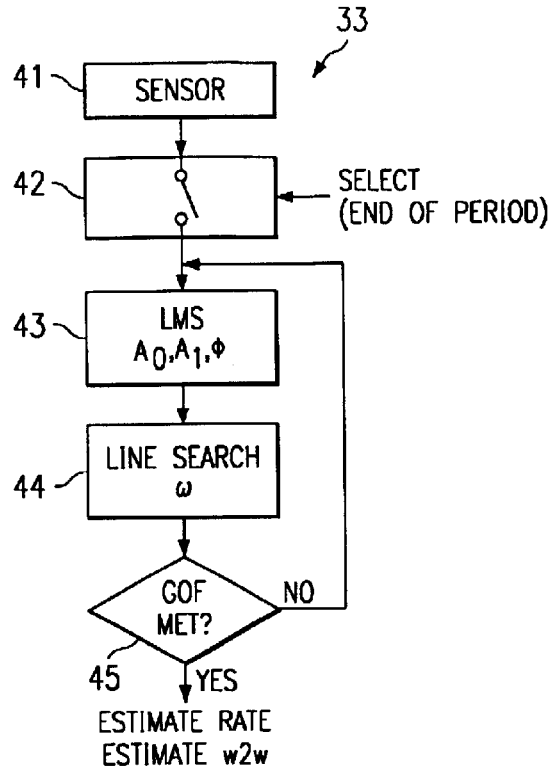
FIG. 6 illustrates the method of estimating polishing rate and wafer to wafer variation according to one embodiment of the present invention.

This paragraph presents the method employed to derive values of $A^*_0$, $A^*_1$, $\bar{\omega}^*$, $\phi^*$ so as to satisfy equation (6). It is clear that in order to satisfy equation (6), for any value of $\bar{\omega}$, the remaining parameters have to satisfy equation (6) in a least squares sense. One could then freeze $\bar{\omega}$, solve for the remaining parameters (let these be denoted by $A_0(\bar{\omega})$, $A_1(\bar{\omega})$, and $\phi(\bar{\omega})$), and then re-optimize the value of $\bar{\omega}$ via gradient descent. This process is illustrated by FIG. 6 steps 41-through 45. The selected sensor 41 samples from the interferometer trace near the end of the polish period are selectively applied 42 to the nonlinear regression algorithm processing wherein the calculating step includes assuming an initial rate and determining what sinusoidal will give the trace by working backward in time and determining a least means square fit. As illustrated the processing includes the least means square processing step 43, determining the search fit in step 44 of the selected rate and the decision step 45 determining if this is the best GOF and the repeated iterative optimization with new rates based on results until the best fit is obtained.

Note that equation (5) can be rewritten at the sampled instances as:

$$\begin{aligned} y_{K-1-k} &= \bar{A}_0+\bar{A}_1\sin(\varpi_0\Delta k+\phi)+v_k \\ &= \bar{A}_0+\bar{A}_1\cos(\bar{\phi})\sin(\varpi_0\Delta k)+\bar{A}_1\sin(\bar{\phi})\cos(\varpi_0\Delta k)+v_k \\ &= \bar{A}_0+\bar{C}_1\sin(\varpi_0\Delta k)+\bar{C}_2\cos(\varpi_0\Delta k)+v_k \end{aligned} \tag{9}$$

Hence, for a fixed $\bar{\omega}$, the lease squares solution $\{A_0(\bar{\omega})\ C_1(\bar{\omega})\ C_2(\bar{\omega})\}$ can be obtained as follows. Define the following:

$$Y = \begin{bmatrix} y_{K-1} \\ y_{K-2} \\ \vdots \\ y_0 \end{bmatrix}; \tag{10}$$

$$X(\varpi) = \begin{bmatrix} 1 & 0 & 1 \\ 1 & \sin(\varpi\Delta) & \cos(\varpi\Delta) \\ 1 & \sin(2\varpi\Delta) & \cos(\varpi\Delta) \\ \vdots & \vdots & \vdots \\ 1 & \sin((K-1)\varpi\Delta) & \cos((K-1)\varpi\Delta) \end{bmatrix}$$

$$\Theta(\varpi) = \begin{bmatrix} A_0(\varpi) \\ C_1(\varpi) \\ C_2(\varpi) \end{bmatrix}; \Lambda = \begin{bmatrix} \lambda_0 & 0 & \dots & 0 \\ 0 & \lambda_1 & \dots & 0 \\ \vdots & \vdots & \ddots & \vdots \\ 0 & 0 & \dots & \lambda_{K-1} \end{bmatrix}; V = \begin{bmatrix} v_0 \\ v_1 \\ \vdots \\ v_{K-1} \end{bmatrix}$$

Then one has $$Y = X(\overline{\omega})\Theta(\overline{\omega}) + V$$

which implies that the weighted least squares solution for $\Theta(\overline{\omega})$ is $$\Theta(\overline{\omega}) = [X^T(\overline{\omega})\Lambda X(\overline{\omega})]^{-1} X^T(\overline{\omega})\Lambda Y. \tag{11}$$

From this $A_1(\overline{\omega})$ and $\phi(\overline{\omega})$ can be obtained via $$A_1(\varpi) = \sqrt{C_1^2(\varpi) + C_2^2(\varpi)} \tag{12}$$

$$\phi(\varpi) = \tan^{-1}\left(\frac{C_2(\varpi)}{C_1(\varpi)}\right)$$

For future reference, define $X'(\overline{\omega})$ as follows:

$$X'(\varpi) = \begin{bmatrix} 0 & 0 & 0 \\ 0 & \Delta\cos(\varpi\Delta) & -\Delta\sin(\varpi\Delta) \\ 0 & 2\Delta\cos(2\varpi\Delta) & -2\Delta\sin(2\varpi\Delta) \\ \vdots & \vdots & \vdots \\ 0 & (K-1)\Delta\cos((K-1)\varpi\Delta) & -(K-1)\Delta\sin((K-1)\varpi\Delta) \end{bmatrix}$$

Therefore the following solves equation (6).

Algorithm:

begin algorithm

Define initial value for $\overline{\omega}_0$.

Set $\gamma_{-1}:=\sigma_{-1}:gof_0:=0$. Define $g_m$, $g_g v$, $\epsilon \approx 0+$. Set $I_{max}$ large.

$Y:=Y-\mu_y$.

i:=0.

Compute $\Theta(\overline{\omega}_i)$.

while $\{(gof_i<1-\epsilon)$ or $(i \leqq I_{max})\}$ do

Compute $\nabla_i := -2\,(Y-X(\overline{\omega}_i))^T\,\Lambda X'(\overline{\omega}_i)\Theta(\overline{\omega}_i)$.

$$\text{If } (\nabla_i = 0),\ \kappa_i := 0,\ \text{else } \kappa_i := \frac{\nabla_i}{\|\nabla_i\|}.$$

$$\gamma_i := \gamma_{i-1}(1-g_g) + g_g \cdot \kappa_i.$$

$$\sigma_i := \sigma_{i-1}(1-g_g) + g_g \cdot \kappa_i^2.$$

$$g_i := g_m \frac{v^2 + 2\gamma_i^2}{v + \gamma_i^2 + \sigma_i}.$$

$$\overline{\omega}_{i+1} := \overline{\omega}_i - g_i \cdot \kappa_i.$$

Compute $\Theta(\overline{\omega}_{i+1})$ via equation (11).

$$e_{i+1} := [Y - X(\overline{\omega}_{i+1})\Theta(\overline{\omega})]^T \Lambda [Y - X(\overline{\omega}_{i+1})\Theta(\overline{\omega})].$$

$$gof_{i+1} := 1 - \frac{e_{i+1}}{Y^T Y}.$$

i:=i+1.

end while.

$$\overline{\omega}^* := \overline{\omega}_i.$$

Compute $\phi^* := \phi(\overline{\omega}^*)$ via equation (12).

end algorithm

Note that the update gain $g_i$ is computed adaptively depending on the sign of the derivative of the error. This is based on the procedure outlined by N. S. Patel and S. T. Jenkins in "Adaptive optimization of run-to-run controllers: The EWMA example," *IEEE Transactions on Semiconductor Manufacturing*, vol. 13, no. 1, pp. 97–100, 2000. Hence, the updates will be more aggressive for large errors, and will diminish in size as the value of $\overline{\omega}_i$ approaches the value which solves equation (6).

Once $\Theta(\overline{\omega})$ is obtained, the value of $A^*_1$, and $\phi^*$ can be obtained via equation (12). Also, $\overline{\omega}_0$ (initial value of $\overline{\omega}$ in algorithm) can be determined from the current estimate of the polish rate via equation (4).

Figure 7A:
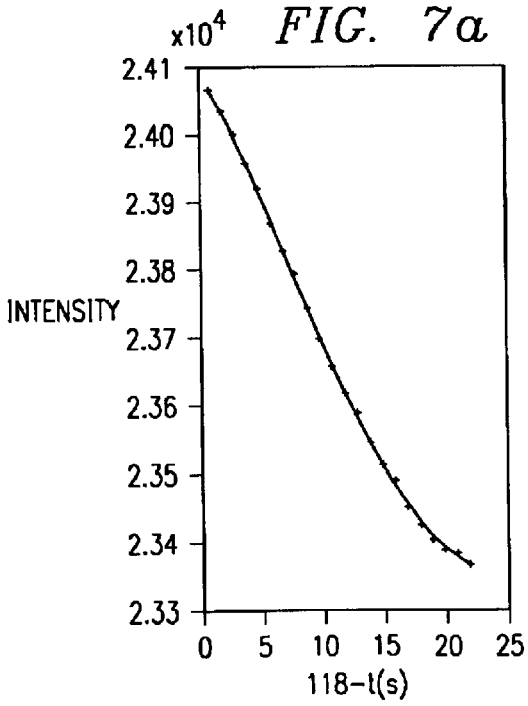
FIG. 7*a* illustrates an example of regression fit where $\omega^*=0.0973$, $\phi^*=2.4037$, GOF=0.9996 and 7*b* where $\omega^*=0.1023$, $\phi^*=0.4522$, GOF=0.9972.
Figure 7B:
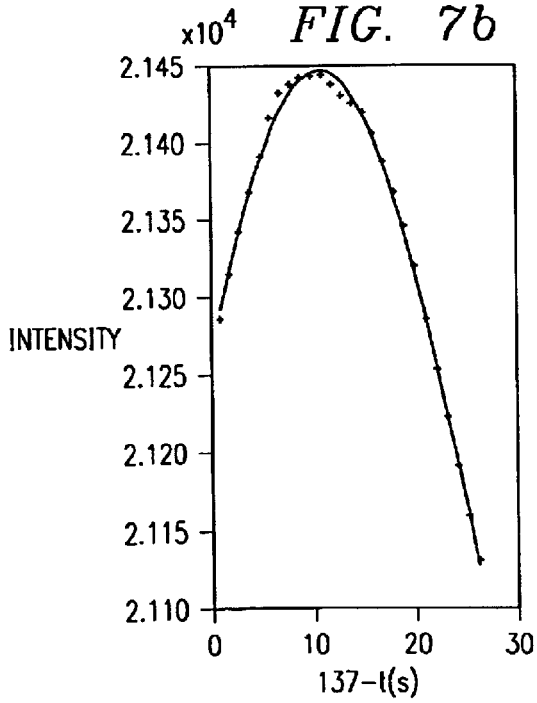
Figure 8A:
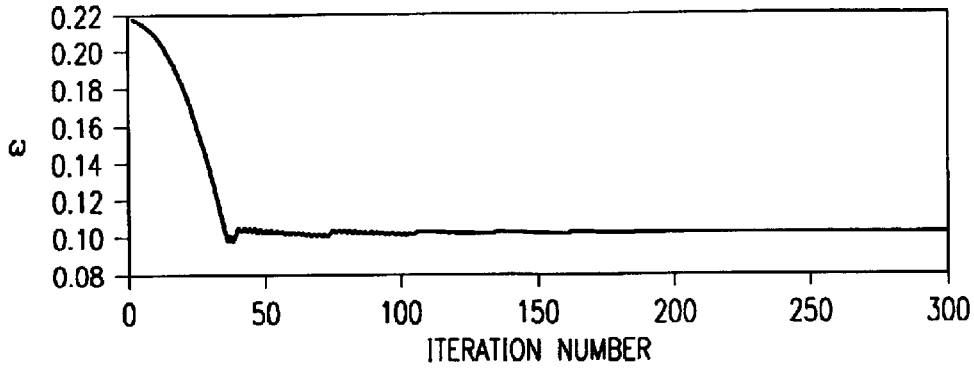
FIG. 8*a* illustrates evolution of $\omega$ and 8*b* evolution of $\phi$ for the trace in FIG. 7*b*.
Figure 8B:
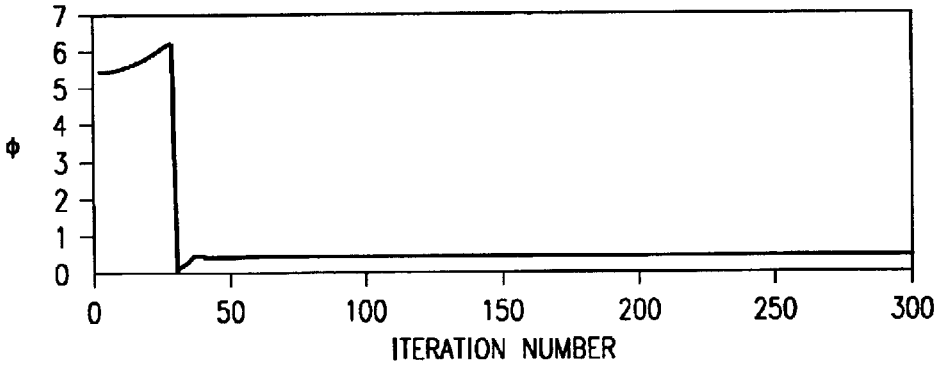
Figure 9A:
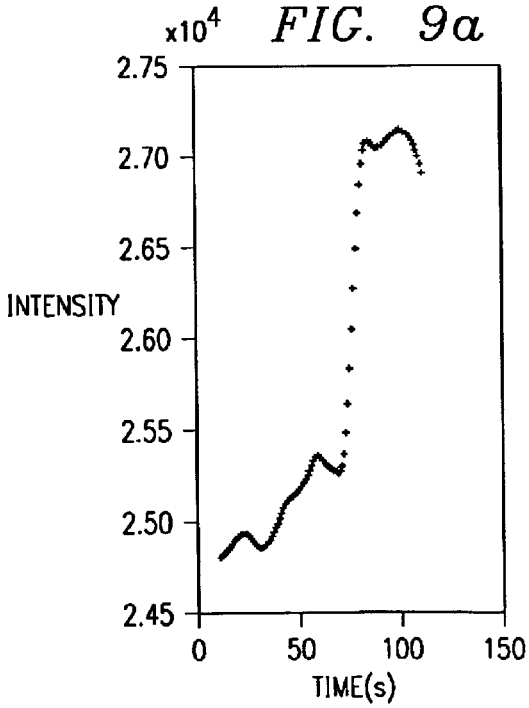
FIG. 9*a* illustrates a bad trace and FIG. 9*b* a fit to this trace has GOF=0.7305 indicating a poor fit.
Figure 9B:
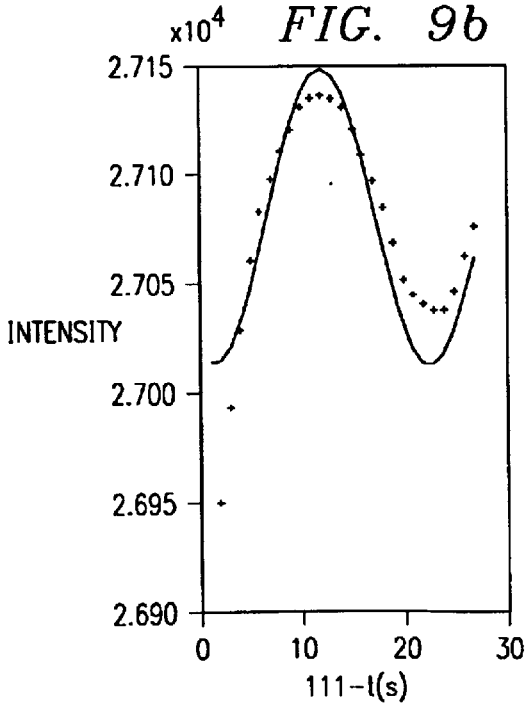

FIG. 7 shows examples of the regression fit, and the values for $\overline{\omega}^*$, $\phi^*$, and GOF obtained for the traces shown in FIG. 4. For the example of FIG. 7(*a*) $\overline{\omega}^*=0.0973$; $\phi^*=2.4037$; GOF=0.9996. For the example of FIG. 7*b* $\overline{\omega}^*=0.1023$; $\phi^*=0.4522$; GOF=0.9972. In all examples considered here, $\lambda_\lambda=1$,k=0. .,K−1. The sample points (y) are shown by "+." In both cases $\overline{\omega}_0$ is chosen as 0.22. FIG. 8 shows the evolution of $\overline{\omega}$, and $\phi$ for the case in FIG. 7(*b*) vs. the algorithm iteration number. The jump in the value of $\phi$ occurs due to rollover to 0 at $2\pi$. Finally, FIG. 9*a* (left) shows an example of a corrupted trace, wherein the trace fails to display intensity modulation of sufficient quality to extract the angular frequency and phase values. FIG. 9*b* (right) shows the samples, and the fitted function. In this case the GOF value falls to 0.7305 indicating a poor fit.

In order to estimate wafer-to-wafer variation, it is assumed that the optical path through the window is dominated by the optical path through the film being polished. Hence, one gets $$\xi \approx K_0 \eta \tag{13}$$

Assuming one inverts the trace in time (as done in equation (5)), the phase of the detected trace at polish stop would be $$\bar{\phi} - \frac{\pi}{2}.$$

Hence, given $\phi^*_1$ as the estimated value of the phase (via equation (6)) for wafer 1, and $\phi^*_2$ as the value for wafer 2, the difference in their final thickness $|\eta_1-\eta_2|$ can be expressed as $$|\eta_1-\eta_2|=N_0(\phi^*_1-\phi^*_2)(\text{modulo } 2\pi). \quad (14)$$

Inversion of the traces makes this comparison independent of the polish rates experienced by the two wafers.

Figure 10:
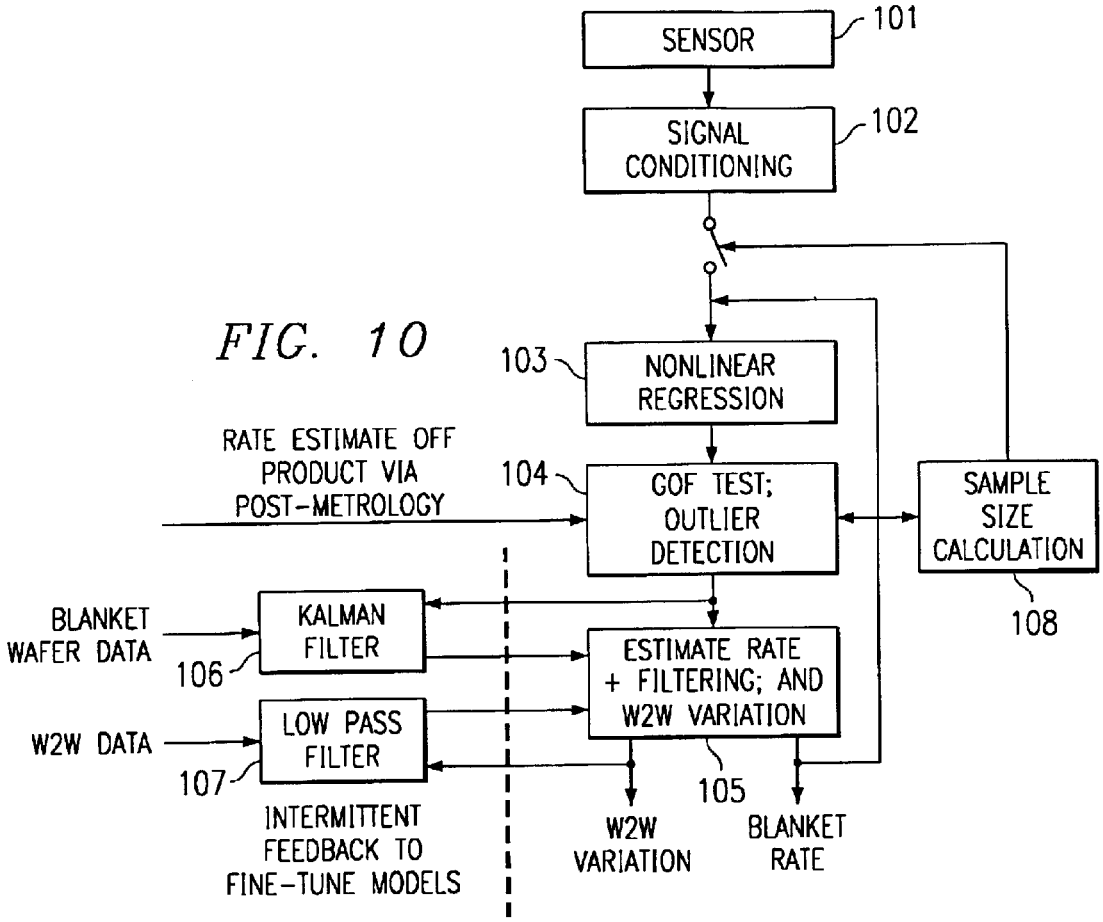
FIG. 10 is a block diagram of the system according to a preferred embodiment of the present invention with intermittent rate and wafer-to-wafer data feedback.

The overall scheme according to one embodiment of the present invention is illustrated in FIG. 10. The system has two main components. The first one basically uses the models for rate vs. angular frequency to estimate blanket polish rates. Phase information is also used to flag large wafer-to-wafer variation. The output from the laser detector sensor 101 is filtered at conditioner 102 and the samples from the end of the trace period are applied to the to the nonlinear regression algorithm processing 103 as discussed above in connection with FIG. 6. The GOF test is performed in step 104 and the estimated rate and the wafer to wafer variation is provided from step 105. It has been determined, for example, that the approximate ¼ wave of samples from the end of the trace provide the best trace. This output may then be used to control the polisher. The other component feeds back rate measurements off blanket wafers (whenever they are run) to fine-tune the models via a Kalman filter 106. See A. P. Sage and C. C. White, III, *Optimum Systems Control*. Englewood Cliffs, N.J.: Prentice-Hall, 2 ed., 1977. Data off multiple wafers (W2W data) is also fed back via filter 107 whenever they are measured in order to fine-tune the wafer-to-wafer (W2W) variation model. In addition, the following additional data paths are shown: (i) The rate estimate is filtered to remove noise at 105, and is fed back to the non-linear regression algorithm processing 103 to seed subsequent iterations; (ii) Rate is also estimated off post-polish metrology, and this is used to validate the quality of the estimates off the interferometry traces at GOF test 104, in particular, it is used to weed out outliers that make it past the GOF test; (iii) The rate estimate is fed back to a sampler 108 that identifies the portion of the trace of interest. The portion of the curve is defined by the planarization characteristics of the polish process, and is typically of the order of a quarter to half of the time period of the trace during blanket polish (as shown in FIG. 5). This portion of the trace $y_{t_k-t_1t_k}$ is determined as follows: suppose one wants $\gamma$ ($1\geqq\gamma>0$) portion of a full cycle for consideration during the curve fit, and let the current estimate of polish rate be $\rho_t$. Then one can compute $t_1$ via (4) as follows:

$$t_1 = \frac{2\pi\gamma\alpha}{\rho_t - \beta} \quad (15)$$

Hence, the number of samples (K) is given by:

$$K = \left\lceil \frac{t_1}{\Delta} \right\rceil$$

Figure 11:
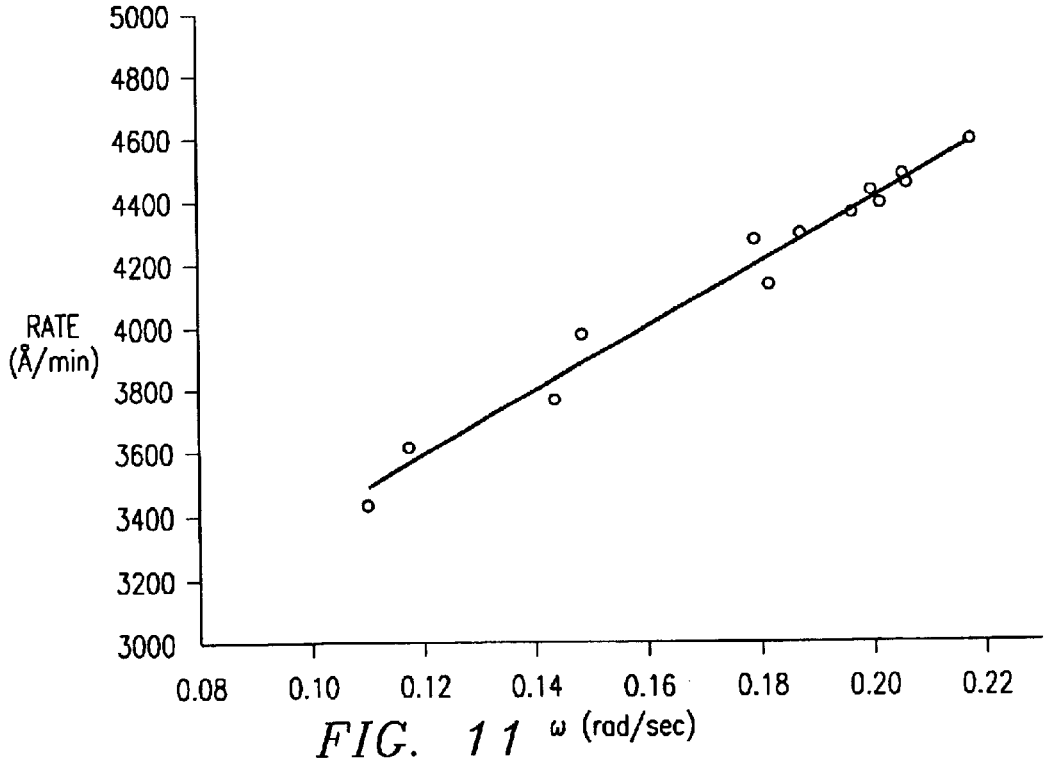
FIG. 11 illustrates blanket rate (Angstrom/min) vs. angular frequency (rad/sec).
Figure 12:
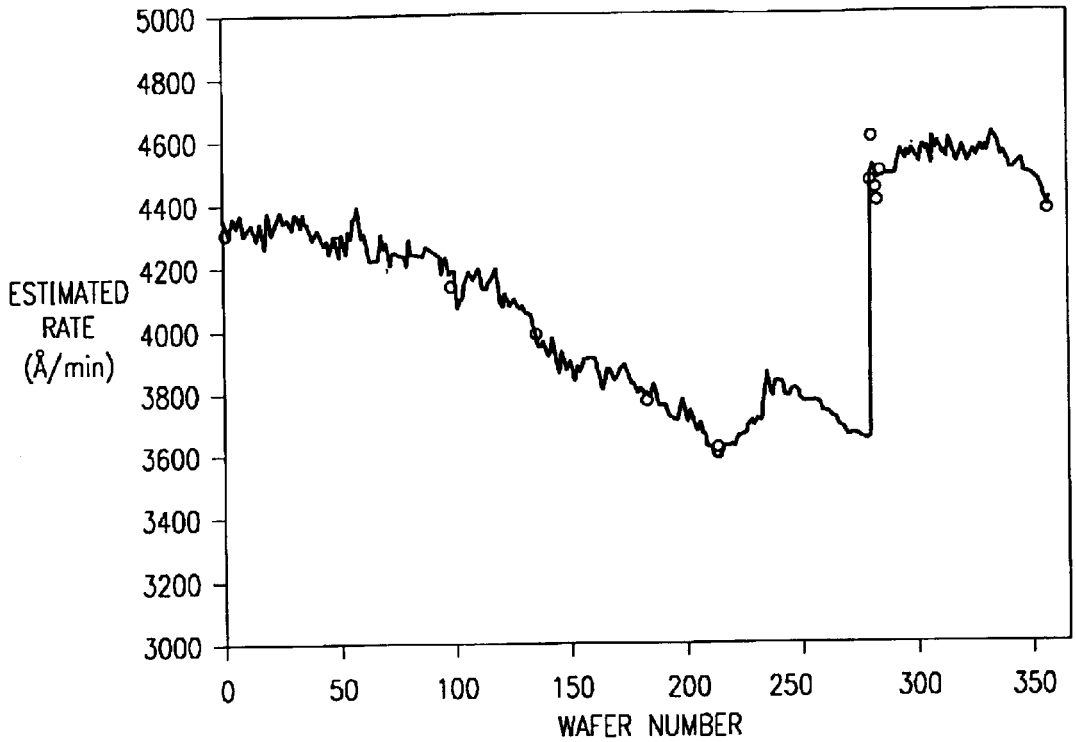
FIG. 12 illustrates estimates blanket rate (Angstrom/min) off product polish with rates measured on quals shown by "o"s.
Figure 13:
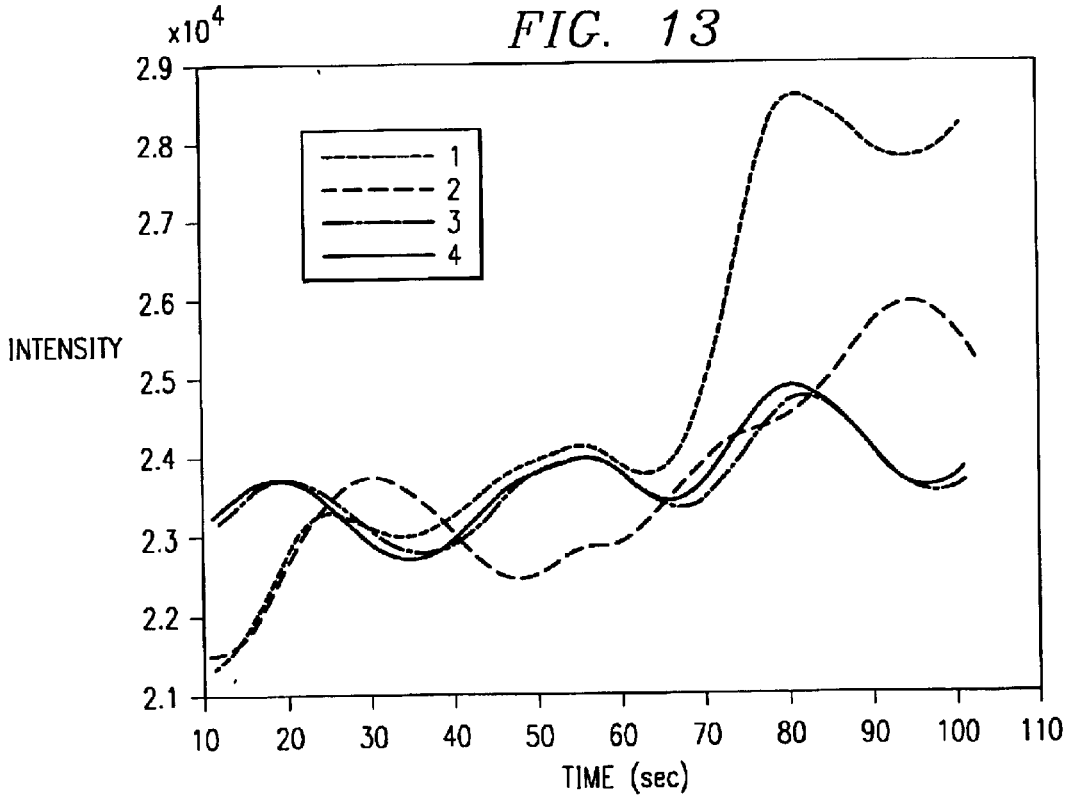
FIG. 13 illustrates traces for four wafers run back-to-back on four different heads.

Validation of the scheme for rate estimation is carried out in two steps. First qual data only is considered to validate the form of equation (4), and to derive the values of 'Y and $\acute{v}$. After that, a 360 wafer production run is considered, across a pad change. Qual wafers are interspersed with product wafers, and the consistency of the rates estimated off product vs. the rates reported by pre- and post-measuring qual wafers is shown. Lastly, an example of wafer-to-wafer variation is considered that shows the impact of thickness variation on the estimated phase $\phi^*$. FIG. 11 shows the measured rate off quals (Angstroms/min) vs. the estimated angular frequency in radians per second ($\omega^*$). The measurements are shown by "o"s and the fit by a line. As seen in the FIG. 11, the data follows a linear fit, and the values of the parameters obtained are 'Y=10056, and $\acute{v}$=2387. All points are within ±100 Å/min of the fit line. FIG. 12 shows the filtered rate estimates obtained off production wafers. The "o"s indicate rate measurements off qual wafers. This shows that the estimated rates off product agree with measured pilot rates. Lastly, consider the case of wafer-to-wafer variation. FIG. 13 shows four traces obtained by wafers run back-to-back through the polisher on four different heads. The estimated values of their phase are: $\phi^*_1$=2.9154; $\phi^*_2$=6.2659; $\phi^*_3$=3.6830; and $\phi^*_4$=3.5271. Based on these, it is immediately clear that there is something wrong with the post-polish thickness for wafer 2. In fact, the measured post-polish thickness values ($\eta$) are: $\eta_1$=10028.2 Å; $\eta_2$=11206.2 Å; $\eta_3$=10321.7 Å; and $\eta_4$=10350 Å. The differences in these thicknesses are linear in the differences in the phase values.

This application presents a method for extracting blanket polish rates off patterned (product) wafer polish by considering the portion of the interferometry signal that corresponds to the blanket polish regime. A nonlinear regression algorithm is presented that can be used to extract the angular frequency, and phase of the interferometry signal. In order to get independence from head polish rates, the signal is flipped around in time prior to application of the regression algorithm. Angular frequency towards the end of polish is shown to correlate to blanket polish rates, and the wafer-to-wafer phase difference to post-polish wafer-to-wafer thickness variation.

This method will enable fast feedback of head polish rates for head-to-head control without requiring additional metrology. In addition measurement delays in fabs running stand-alone metrology will be eliminated for estimating polish rates. This will lead to improved control without additional capital expenditure. Also, since the blanket rates can in essence be estimated off product, this will also enable reduction of rate quals. Finally, even though a limited number of wafers may be post-measured, tracking phase differences across all wafers in a lot will help flag lots with extreme thickness variation that could lead to parametric, or multiprobe failure.

While the invention has been described by reference to preferred embodiments described above, it is understood that variations and modifications thereof may be made without departing from the spirit and scope of the invention.

What is claimed is:

1. A method of estimation of blanket polish rates for product wafers comprising the steps of:

sensing sample signals representing polishing trace from product wafers and processing said sample signals from product wafers using samples taken near the end of polishing period to get a processed rate estimate.

2. The method of claim 1 wherein said end of polishing period is in the planarization region.

3. The method of claim 1 wherein said sensing includes an interferometer.

4. The method of claim 3 wherein said processing step includes calculating estimates using sample signals from less than a full interferometry trace cycle.

5. The method of claim 4 wherein said processing step includes calculating estimates using a non-linear regression algorithm and iterative optimization processing.

6. The method of claim 5 wherein said processing step includes assuming an initial rate and determining what sinusoidal will give the trace by working backward in time and determining a least mean square fit.

7. The method of claim 6 including filtering said rate estimate to remove noise and feeding back to the nonlinear regression algorithm to seed subsequent iterations.

8. The method of claim 6 including the step of estimating rate of post-polish metrology to validate estimates and weed out outliers that make it past the fit metric.

9. The method of claim 6 including the step of feeding rate estimate fed back to a sampler that identifies the portion of the trace of interest and selecting samples from that portion of the trace for processing.

10. The method of claim 1 wherein said samples taken are approximately ¼ wave of samples from the end of the polish trace.

* * * * *